US008816911B2

(12) United States Patent
Huber et al.

(10) Patent No.: US 8,816,911 B2
(45) Date of Patent: Aug. 26, 2014

(54) MULTIPLE RESONANT ANTENNA UNIT, ASSOCIATED PRINTED CIRCUIT BOARD AND RADIO COMMUNICATION

(75) Inventors: Stefan Huber, Munich (DE); Michael Schreiber, Aying-Goggenhofen (DE)

(73) Assignee: QUALCOMM Incorporated, San Diego, CA (US)

( * ) Notice: Subject to any disclaimer, the term of this patent is extended or adjusted under 35 U.S.C. 154(b) by 1453 days.

(21) Appl. No.: 12/090,783

(22) PCT Filed: Oct. 18, 2006

(86) PCT No.: PCT/EP2006/067530

§ 371 (c)(1),
(2), (4) Date: Oct. 28, 2009

(87) PCT Pub. No.: WO2007/045665

PCT Pub. Date: Apr. 26, 2007

(65) Prior Publication Data

US 2009/0219215 A1 Sep. 3, 2009

(30) Foreign Application Priority Data

Oct. 18, 2005 (DE) ..... 10 2005 049 820

(51) Int. Cl.

| | |
|---|---|
| ***H01Q 1/24*** | (2006.01) |
| ***H01Q 1/38*** | (2006.01) |
| ***H01Q 9/42*** | (2006.01) |
| ***H01Q 5/00*** | (2006.01) |
| ***H01Q 9/04*** | (2006.01) |

(52) U.S. Cl.

CPC ..... *H01Q 5/0051* (2013.01); *H01Q 1/38* (2013.01); *H01Q 9/42* (2013.01); *H01Q 9/04* (2013.01); *H01Q 5/0093* (2013.01); *H01Q 1/243* (2013.01)

USPC ..... 343/702; 343/895; 343/700 MS

(58) Field of Classification Search

CPC ..... H01Q 1/243; H01Q 1/38; H01Q 11/08

USPC ..... 343/702, 895, 700 MS

See application file for complete search history.

(56) References Cited

U.S. PATENT DOCUMENTS 5,928,455 A * 7/1999 Dizin et al. ..... 156/276
6,111,545 A * 8/2000 Saari ..... 343/702

(Continued)

FOREIGN PATENT DOCUMENTS

DE 10341310 A1 3/2004
DE 10302805 A1 * 8/2004 ..... H01Q 21/30

(Continued)

OTHER PUBLICATIONS

International Search Report and Written Opinion—PCT/EP2006/067530—ISAEPO—Jan. 31, 2007.

*Primary Examiner* — Dameon E Levi
*Assistant Examiner* — Collin Dawkins
(74) *Attorney, Agent, or Firm* — Mehamedi Paradice LLP

(57) ABSTRACT

A multiple resonant antenna unit (AT2) comprises a current feed area (SPI) from which only a single, spiral-like antenna branch (AZI) emanates. The total course of this spiral-like antenna branch (AZI) forms a first resonant antenna structure for a low frequency range and at least one partial section (SE15) inside the total course of this spiral-like antenna structure (AZI) forms a second resonant antenna structure for a higher frequency range.

21 Claims, 3 Drawing Sheets

(56) References Cited

U.S. PATENT DOCUMENTS

| | | | | |
|---|---|---|---|---|
| 6,204,826 | B1 * | 3/2001 | Rutkowski et al. | 343/895 |
| 6,295,029 | B1 * | 9/2001 | Chen et al. | 343/700 MS |
| 6,795,026 | B2 * | 9/2004 | Chiu et al. | 343/702 |
| 6,894,646 | B2 * | 5/2005 | Washiro et al. | 343/700 MS |
| 6,930,640 | B2 * | 8/2005 | Chung et al. | 343/700 MS |
| 2004/0080457 | A1 * | 4/2004 | Guo et al. | 343/700 MS |
| 2004/0130493 | A1 * | 7/2004 | Horita et al. | 343/702 |
| 2005/0001767 | A1 * | 1/2005 | Wulff et al. | 343/700 MS |
| 2005/0001773 | A1 * | 1/2005 | Morningstar et al. | 343/702 |
| 2005/0007279 | A1 | 1/2005 | Chang | |
| 2005/0024271 | A1 * | 2/2005 | Ying et al. | 343/702 |
| 2006/0055602 | A1 * | 3/2006 | Huber et al. | 343/700 MS |
| 2013/0135150 | A1 | 5/2013 | Kenoun et al. | |

FOREIGN PATENT DOCUMENTS

| | | | | |
|---|---|---|---|---|
| DE | 10302805 | A1 * | 8/2004 | H01Q 21/30 |
| EP | 0938158 | A2 | 8/1999 | |
| EP | 1154518 | A2 | 11/2001 | |
| WO | WO 00/77884 | A | 12/2000 | |
| WO | WO 01/08260 | A | 2/2001 | |
| WO | WO 2005076407 | A2 * | 8/2005 | H01Q 1/38 |

* cited by examiner

MULTIPLE RESONANT ANTENNA UNIT, ASSOCIATED PRINTED CIRCUIT BOARD AND RADIO COMMUNICATION

CLAIM FOR PRIORITY

This application is a national stage application of PCT/EP2006/067530, filed Oct. 18, 2006, which claims the benefit of priority to German Application No. 10 2005 049 820.5, filed Oct. 18, 2005, the contents of which hereby incorporated by reference.

TECHNICAL FIELD OF THE INVENTION

The invention relates to a multiple resonant antenna unit, printed circuit board and radio communication device.

BACKGROUND OF THE INVENTION

For radio communication devices, stub antennas are used which project over the housing of said devices, i.e. are arranged outside the housing. Stub antennas of this type which stick out may make the respective wireless communication device awkward to handle, may bend or even snap under mechanical loads which are too high. They also affect the visual appearance for some desired shapes or constructions of the housing of the radio communication device.

On the other hand, patch antennas, i.e. flat antennas, are also used in radio communication devices. These antennas usually comprise at least two current feed contacts, by means of which spatially separated, i.e. separate, patch regions are electromagnetically excited which are associated with at least two different frequency ranges. In some cases, patch antennas of this type may require too much space in the respective radio communication device. In addition, their current feed via their at least two separate contacts may be too complex. Furthermore, it is also possible for there to be undesired electromagnetic coupling effects between their two current feed contacts.

SUMMARY OF THE INVENTION

The invention provides a smaller multiple resonant antenna unit for sending and/or receiving radio radiation fields in at least two frequency ranges which can be fed with electricity in a simple manner. This object is achieved by the following multiple resonant antenna unit.

In one embodiment of the invention, there is a multiple resonant antenna unit comprising a current feed region, from which only a single, spiral antenna branch emanates, wherein the total course of the spiral antenna branch forms a first resonant antenna structure for a lower frequency range and at least one portion inside the total course of the spiral antenna branch forms a second resonant antenna structure for a higher frequency range.

Since a single spiral antenna branch emanates from an individual current feed region, the total course of which antenna branch forms a first resonant antenna structure for a lower frequency range and at least a portion of which inside its total course simultaneously acts as a second resonant antenna structure for a higher frequency range, the space required for this antenna structure is further reduced. In other words, the second antenna structure is an integrated component inside the total course of the first antenna structure. In particular, the second antenna structure forms merely part of the length of the total course of the first antenna structure. In this manner, a multiple resonant antenna unit of this type is advantageously housed, in particular, inside the housing of a radio communication device, without excessively affecting the space required for the plurality of electrical components to be housed there, such as, for example, a printed circuit board, keyboard control, display, etc.

The invention further relates to a printed circuit board and a radio communication device comprising at least one multiple resonant antenna unit according to the invention.

BRIEF DESCRIPTION OF THE DRAWINGS

The invention and its developments will be explained hereinafter in greater detail with reference to the drawings, in which.

Each element having the same function and mode of operation is denoted in FIGS. 1 to 6 with the same reference numeral.

DETAILED DESCRIPTION OF THE INVENTION

Figure 1:
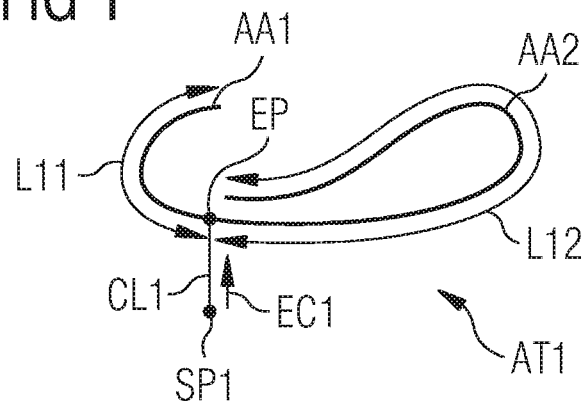
FIG. 1 is a schematic enlarged view of an antenna unit comprising two separate antenna branches for two different frequency bands.

As many separate sending and receiving antennas as desired frequency bands may be provided for radio communication devices which work in a range of frequency bands. FIG. 1 is an exemplary schematic and enlarged view of an antenna structure AT1 used in radio communication devices and comprising two separate antenna branches or antenna limbs AA1, AA2 for two different frequency bands. Each antenna branch AA1 or AA2 is formed by an electrically conductive, lamellar conductive track and/or an electrically conductive wire. The first antenna branch AA1 and the second antenna branch AA2 comprise a common base FP, that is to say they are connected at their input-side end faces in order to be fed with the electric current EC1 of a current feed region SP1 via a common electrical contact line CL1. Said current feed region SP1 may be either planar or point-shaped. In FIG. 1, the current feed region SP1 is shown, in an exemplary manner, to be point-shaped. It represents the location where the electric current EC1 is input and thus also represents a current source. Starting from the common base FP, the two antenna branches AA1, AA2 extend so as to be spatially separated from one another in different spatial directions. In other words, the two antenna branches AA1, AA2 protrude freely into different spatial regions or zones. As a result, the length L11 of the first antenna branch AA1 is selected so as to be smaller than the length L12 of the second antenna branch AA2. By using the shorter antenna branch AA1, radio radiation fields may therefore be emitted and/or received which are in a higher frequency range than those emitted and/or received using the longer antenna branch AA2. By using the longer antenna branch AA2, it is therefore possible to send and/or receive electromagnetic radio radiation fields which are in a lower frequency range than those sent and/or received by using the shorter antenna branch AA1. The length L12 of the longer antenna branch AA2 is substantially preferably selected to be $\lambda/4$, that is to say a quarter of the resonance wavelength of the lower frequency range, or multiples of $\lambda/4$ so as to form vertical electromagnetic waves and also to uncouple and/or couple electromagnetic radio waves. In a corresponding manner, the length L11 of the shorter antenna branch AA1 substantially corresponds to λ/4 of the resonance wavelength λ of the higher frequency range or multiples of λ/4 of the higher frequency range. In the present embodiment of FIG. 1, the longer antenna branch AA2 is shaped as an open loop or hoop as a first approximation. In particular, the upper portion of the longer antenna branch AA2 is in the shape of a lowercase "l" as a first approximation. The shorter antenna branch is shaped so as to be half round and half oval. In this manner, the two antenna branches AA1, AA2 of the known antenna structure AT1 function as two separate stub antennas. An antenna structure of this type with two separate antenna branches may, in practice, require too much space in some cases. This is particularly the case if the antenna structure is to be housed inside the housing of a radio communication device, which already houses a plurality of other electrical components.

Figure 2:
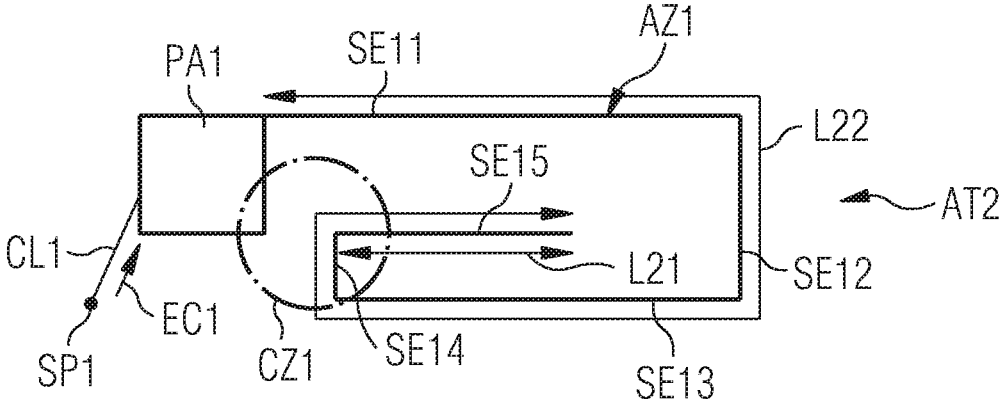
FIG. 2 is a schematic enlarged view of a first embodiment of a multiple resonant antenna unit according to the invention.

FIG. 2 is a schematic enlarged view of a first multiple resonant antenna unit AT2 with an antenna structure which is more compact than the antenna structure AT1 in FIG. 1. This multiple resonant antenna unit AT2 comprises merely one single current feed region SP1. Said region may be flat or point-shaped. It is supplied by an electric current source which has been omitted in FIG. 2 for the sake of visual clarity. Starting from said single, i.e. merely one, current feed region SP1, the electric current EC1 thereof flows via an electrical contact line CL1 to what is known as a patch element PA1, i.e. an electrically conductive surface element. Said element is substantially square in the embodiment in FIG. 2. From said patch element PA1 merely a single spiral antenna branch AZ1 emanates. Said spiral antenna branch AZ1 is composed of portions SE11, SE12, SE13, SE14 and SE15 arranged at right angles to one another. The portions SE11 to SE15 are thus formed by lamellar conductive tracks and/or electrically conductive wires. The input-side portion SE11 of the spiral antenna branch AZ1 extends from the upper edge of the square patch element PA1 along the extension thereof, which is intended to be linear. The second portion SE12 is connected to said portion SE11 at an angle of 90° thereto. The third linear portion SE13 is offset at 90° to the linear extension of the second portion SE12. The same applies to the subsequent fourth portion SE14 and the fifth portion SE15. As a result, the end-side portion SE15 protrudes freely into the space. It extends substantially parallel to the first portion SE11. The fourth and second portions SE12, SE14 also extend substantially parallel to one another.

To summarise, the portions SE11 to SE14 are arranged successively in such a way that, starting from the patch element PA1, they form an inwardly spiralling spiral. In this embodiment said spiral comprises, in particular, square bent comers at the places where each two portions meet. Of course, it is also possible for the individual antenna branch to be of another shape. It may therefore be expedient, for example, for the individual antenna branch to be provided as an inwardly spiralling ellipsoidal or circular spiral. It may alternatively be expedient to provide an outwardly spiralling spiral as the antenna branch, the end portion of which protrudes freely.

Advantageously, all components of the first antenna unit AT2, i.e., in particular, the point-shaped current feed region SP1, the contact line CL1, the patch element PA1 and the portions SE11 to SE14 of the antenna branch AZ1, are arranged substantially in the same plane so an antenna structure is formed which is planar as a first approximation.

The total course of the spiral antenna branch AZ1 has a total length L22. Said total course of the spiral antenna branch AZ1 forms a first resonant antenna structure for a first frequency range. At the same time, the freely protruding end-side portion SE15 of said spiral antenna branch AZ1 functions as a second resonant antenna structure for a second frequency range. Since the end-side portion SE15 constitutes merely a partial length L21 of the total length L22 of the entire spiral antenna branch AZ1, a higher frequency range is associated with the end-side portion SE15 than with the total course of the spiral antenna branch AZ1.

In order to electromagnetically excite the end-side portion SE15, said portion is arranged relative to the input-side patch element PA1 in such a way that it is inductively and/or capacitively coupled, that is to say, generally speaking, electromagnetically coupled, to said patch element. For this purpose, it is particularly expedient for the input-side end of the freely protruding portion SE15, which is connected to the preceding portion SE14, to be arranged in the vicinity of the patch element PA1. The electromagnetic transmitting region is represented in FIG. 2 by a delimiting dot and dash line and is denoted by the reference CZ1.

The ratio of the length L21 of the end-side portion SE15 to the total length L22 of the spiral antenna branch AZ1 is expediently substantially the same as the ratio of the associated higher frequency range to the associated lower frequency range. The total length L22 of the spiral antenna branch AZ1 is preferably selected to be between 70 and 90 mm. The length L21 of the end-side portion SE15 of the spiral antenna branch AZ1 is preferably between 10 and 25 mm. The length L21 of the end-side portion SE15 is therefore preferably approximately one quarter of the resonance wavelength of the higher frequency range, i.e. approximately λ/4, λ being the resonance wavelength of the higher frequency range. The length L21 may also expediently be a multiple of λ/4. Similarly, the total length L22 of the spiral antenna branch is selected to be substantially one quarter of the resonance wavelength of the lower frequency range, or a multiple of λ/4.

In this manner, a uniaxial spiral antenna structure is provided, of which the total course forms a first resonant antenna structure for a lower frequency range and of which the freely protruding end-side portion simultaneously acts as a second resonant antenna structure for a higher frequency range. As a result, the single spiral antenna branch itself adopts the function and mode of operation of two separate antenna branches, such as, for example, AA1 and AA2 of the antenna structure of AT1 in FIG. 1. In this manner, the multiple resonant antenna unit comprising only the single spiral antenna branch, of which the total course forms a first resonant antenna structure for a lower frequency range and of which the end-side portion provides a second resonant antenna structure for a higher frequency range, takes up less space than the known antenna structure AT1 in FIG. 1, which comprises two spatially separate antenna branches AA1 and AA2.

Figure 3:
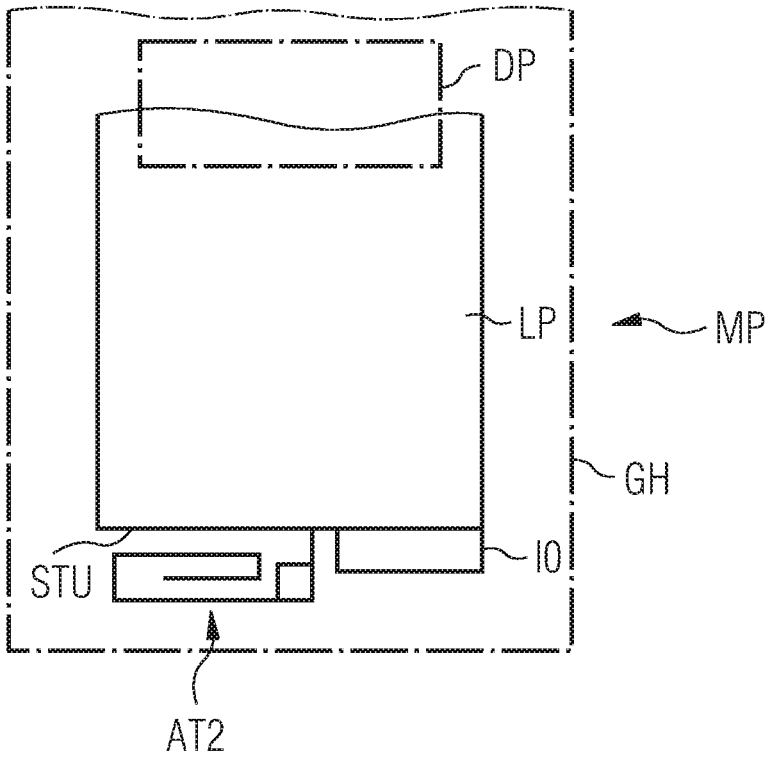
FIG. 3 is a schematic view of a printed circuit board inside the housing of a radio communication device, to which printed circuit board the antenna shown in FIG. 2 is coupled.

FIG. 3 shows a schematic detail of a printed circuit board LP of a radio communication device MP, of which the outer housing GH is shown as a dot and dash line. In the upper half of the printed circuit board LP, the lower part of the display or the display means DP of the radio communication device MP is also shown. The multiple resonant antenna unit AT2 from FIG. 2 is connected to the lower end face STU of the printed circuit board LP, which is further away from the display DP than the upper end face of the printed circuit board LP which is not shown. The multiple resonant antenna unit is configured so as to be compact in such a way that there is also space on the printed circuit board LP for an input/output port, a microphone, a loudspeaker IO or another electrical and/or mechanical component.

The multiple resonant antenna unit according to the invention is characterised, in particular, in that it takes up less space inside the housing GH so there is more interior space available for the plurality of further electrical components and so the radio communication device MP can be of a very compact size. In particular, a further miniaturisation is possible.

Figure 4:
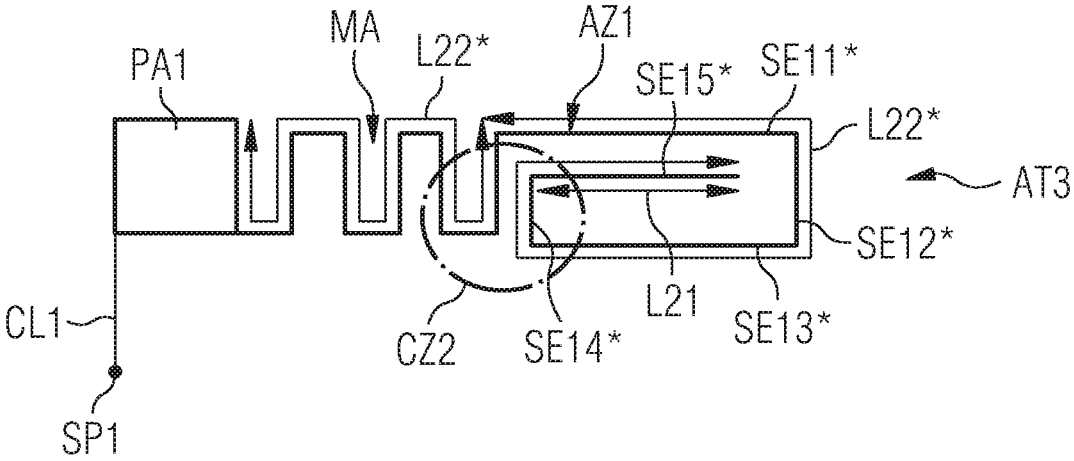
FIGS. 4 to 6 show three further variations of a multiple resonant antenna unit according to the invention.

FIG. 4 shows a schematic and enlarged view of a third advantageous multiple resonant antenna unit AT3 which is produced by modifying the second multiple resonant antenna unit AT2 shown in FIG. 2. In contrast to FIG. 2, a meandering conductive track MA is also positioned in the third antenna unit AT3 between the spiral antenna branch AZ1 and the input-side patch element PA1. This allows the length of the spiral antenna branch AZ1 to be extended by means of the meandering extension LL2* along a relatively short linear portion.

For both forms of antenna units AT2 and AT3 in FIGS. 2 and 4, the function of the input-side patch element PA1 is, in particular, to enlarge the band width of the lower frequency range. Said band width enlargement is, in particular, advantageous for the GSM frequency band of 900 MHz.

It may also optionally be satisfactory to omit the input-side patch element PA1 and to connect the current feed region SP1 directly to the input-side end of the one-piece spiral antenna branch AZ1 via the electrical contact conductor CL1 or to interpose only the meandering conductor track MA.

In order to electromagnetically excite the freely protruding end-side portion SE15 of the antenna unit AT3 in FIG. 4, said portion is arranged relative to the input-side meandering portion MA in such a way that an inductive and/or capacitive coupling region CZ2, i.e., generally speaking, an electromagnetic coupling, is formed therebetween.

Figure 5:
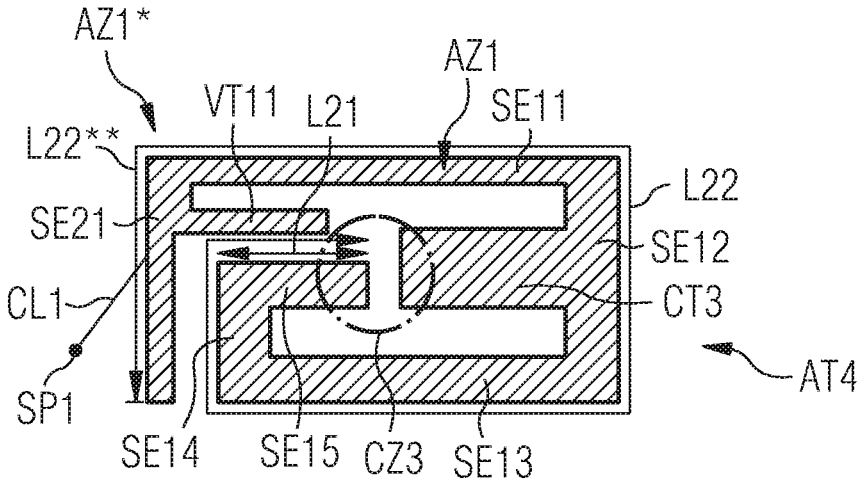

FIG. 5 shows a schematic and enlarged view of a third multiple resonant antenna unit according to the invention which is modified with regard to the first antenna unit AT2 according to the invention shown in FIG. 2. In contrast to FIG. 2, the single spiral antenna branch AZ1 is added around an input-side portion SE21. Said input-side portion SE21 is offset at 270° to the linear extension of the portion SE11 and laterally ends the spiral antenna branch AZ1. It extends substantially parallel to the portion SE12. As a result, the entire length L32 of the modified spiral antenna branch AZ1* of the third multiple resonant antenna unit AT4 around the length L22 is longer than that of the antenna branch AZ1. At the input-side portion SE21, a transverse web VT11 extending inwardly into the structure of the spiral antenna branch AZ1* is provided transversely to the longitudinal extension of said portion. The transverse web acts as the bandwidth enlargement for the lower frequency range, which is associated with the total course of the modified spiral antenna branch AZ1*. In particular, the transverse web VT11 is substantially arranged perpendicular to the axial longitudinal extension of the input-side portion SE21. In particular, the input-side portion SE21 represents the left-hand side frame of an intended rectangle, which forms the outer frame of the multiple resonant antenna unit AT4. On the opposite broad side of said intended rectangle, the portion SE12 comprises a transverse bar CT3 extending inside the spiral of the antenna branch AZ1* and which extends substantially at a right-angle to the axial longitudinal extension of the portion SE12. It electromagnetically excites the inwardly freely protruding end portion SE15 of the spiral antenna branch AZ1*. For this purpose, the transverse bar CT3 is inductively and/or capacitively coupled to the end portion SE15** protruding at the end side.

Figure 6:
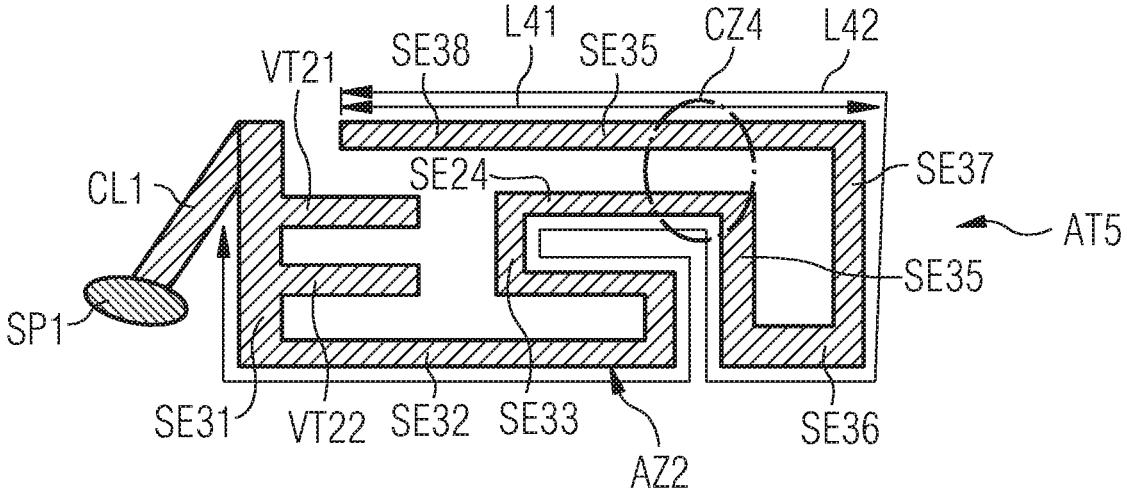

FIG. 6 shows a further advantageous multiple resonant antenna unit AT5. Starting from the current feed region SP1 it comprises merely a single antenna branch AZ2 which, in contrast to the antenna branches of the antenna units AT2, AT3 and AT4, spirals outwardly. The antenna branch AZ2 consists of, in particular, portions SE31 to SE38 arranged at right angles to one another. The electrical coupling between the current feed region SP1 and the input-side portion SE31 therefore results via the electrical contact line CL1. The input-side portion SE31 comprises, transversely to its axial longitudinal extension, two transverse bars VT21 and VT22 which enlarge the bandwidth of the lower frequency range. The portions SE31 to SE38 are approximately arranged in such a way that their intended outer frame is substantially rectangular when viewed as a whole. As a result, the input-side first portion SE31 roughly forms the left broad side and the portion SE37 roughly forms the right broad side of said intended rectangle. The portions SE32 and SE36 extend along the lower longitudinal edge of said intended rectangle whilst the freely protruding end-side portion SE38 of the spiral antenna branch AZ2 extends along the upper longitudinal side of said intended rectangle. The portions SE33, SE34 and SE35 form a protuberance into the inside of the spiral of the antenna branch AZ2, i.e. a bulge in the linear longitudinal extension of the portions SE32 and SE36 inside the spiral of the antenna branch AZ2. As a result, an inductive and/or capacitive coupling between the portion SE34 and the end-side portion SE38 is formed, said end portion being electromagnetically excited along its length L41 for the higher frequency range. On the other hand, the total extension of the antenna branch AZ2 along its total length L42 acts as a resonant antenna structure for the lower frequency range.

Generally speaking, it is advantageous for at least one preceding branch or portion, such as, for example, CT3, of the entire portion of the respective single antenna branch, such as, for example, AZ1* and AZ2, which functions as a first antenna branch for emitting and/or receiving radio rays of a lower frequency range, to be inductively and/or capacitively coupled to the portion which is associated with the higher frequency range, in particular to the freely protruding end-side portion thereof, such as, for example, SE15 , in such a way that said branch acts as a second antenna branch for a higher frequency range. Said second antenna branch is thus integrated into the entire length of the extension of the first antenna branch, i.e. it forms a partial length of the total length of the first antenna branch and is thus an integrated component of the first antenna branch.

The invention claimed is:

1. A multiple resonant antenna unit comprising:

an electrically conductive surface element coupled to a current feed region; and a single, spiral antenna branch that is coplanar with and that extends from the surface element, the spiral antenna branch having a total length from the surface element to an end of the spiral antenna branch, wherein:

the entirety of the spiral antenna branch forms a first resonant antenna structure for a lower frequency range;

an end portion of the spiral antenna branch, having a partial length of the total length, forms a second resonant antenna structure for a higher frequency range;

the end portion is coplanar with the surface element and is electromagnetically coupled to the surface element; and the electrically conductive surface element is interposed between the current feed region and the spiral antenna branch.

2. The multiple resonant antenna unit of claim 1, wherein the surface element is substantially rectangular in shape.

3. The multiple resonant antenna unit of claim 2, wherein each of a width and a length of the surface element is substantially larger than a width of the spiral antenna branch.

4. The multiple resonant antenna unit of claim 1, wherein the spiral antenna branch is composed of portions that are arranged at right angles to adjacent portions.

5. The multiple resonant antenna unit of claim 1, wherein the spiral antenna branch is formed by lamellar conductive tracks or wires.

6. The multiple resonant antenna unit of claim 4, wherein the spiral antenna branch is arranged to spiral inwards so that the end portion of the spiral antenna branch is at least partially encircled by other portions of the spiral antenna branch.

7. The multiple resonant antenna unit of claim 1, wherein a ratio of the partial length of the end portion to the total length of the spiral antenna branch is substantially equal to a ratio of the higher frequency range to the lower frequency range.

8. The multiple resonant antenna unit of claim 7, wherein the total length of the spiral antenna branch is between 70 and 90mm.

9. The multiple resonant antenna unit of claim 7, wherein the partial length of the end portion of the spiral antenna branch is between 10 and 25 mm.

10. A printed circuit board assembly comprising:

a printed circuit board; and at least one multiple resonant antenna unit coupled to the printed circuit board, the multiple resonant antenna unit comprising:

an electrically conductive surface element coupled to a current feed region via a contact line; and a single, spiral antenna branch that is coplanar with and that extends from the surface element, the spiral antenna branch having a total length from the surface element to an end of the spiral antenna branch, wherein:

the entirety of the spiral antenna branch forms a first resonant antenna structure for a lower frequency range;

an end portion of the spiral antenna branch, having a partial length of the total length, forms a second resonant antenna structure for a higher frequency range;

the end portion is coplanar with the surface element and is electromagnetically coupled to the surface element; and the electrically conductive surface element is interposed between the current feed region and the spiral antenna branch.

11. The printed circuit board assembly of claim 10, wherein the multiple resonant antenna unit is fixed to a lower end face of the printed circuit board.

12. A radio communication device comprising:

at least one multiple resonant antenna unit comprising:

an electrically conductive surface element coupled to the current feed region; and a single, spiral antenna branch that is coplanar with and that extends from the surface element, the spiral antenna branch having a total length from the surface element to an end of the spiral antenna branch, wherein:

the entirety of the spiral antenna branch forms a first resonant antenna structure for a lower frequency range;

an end portion of the spiral antenna branch, having a partial length of the total length, forms a second resonant antenna structure for a higher frequency range;

the end portion is coplanar with the surface element and is electromagnetically coupled to the surface element; and the electrically conductive surface element is interposed between the current feed region and the spiral antenna branch.

13. The radio communication device of claim 11, further comprising:

a housing; and a printed circuit board, wherein the multiple resonant antenna unit is coupled to the printed circuit board within the housing of the radio communication device.

14. The radio communication device of claim 12, wherein the surface element of the multiple resonant antenna unit is substantially rectangular in shape, and wherein each of a width and a length of the surface element is substantially larger than a width of the spiral antenna branch.

15. The radio communication device of claim 14, wherein the spiral antenna branch is arranged to spiral inwards so that the end portion of the spiral antenna branch is at least partially encircled by other portions of the spiral antenna branch.

16. The radio communication device of claim 12, wherein the spiral antenna branch of the multiple resonant antenna unit is formed by lamellar conductive tracks or wires.

17. The radio communication device of claim 12, wherein the spiral antenna branch is composed of portions that are arranged at right angles to adjacent portions.

18. The radio communication device of claim 12, wherein a ratio of the partial length of the end portion to the total length of the spiral antenna branch is substantially equal to a ratio of the higher frequency range to the lower frequency range.

19. The radio communication device of claim 18, wherein the total length of the spiral antenna branch is between 70 and 90 mm.

20. The radio communication device of claim 18, wherein the partial length of the end portion of the spiral antenna branch is between 10 and 25 mm.

21. A multiple resonant antenna unit comprising:

an electrically conductive surface element coupled to a current feed region;

a meandering conductive track that extends from the surface element, wherein the surface element is interposed between the current feed region and the meandering conductive track; and a single, spiral antenna branch that extends from the meandering conductive track, wherein the meandering conductive track is interposed between the surface element and the spiral antenna branch, the spiral antenna branch having a total length from the surface element to an end of the spiral antenna branch;

wherein the entirety of the meandering conductive track and the entirety of the spiral antenna branch together form a first resonant antenna structure for a lower frequency range, wherein an end portion of the spiral antenna branch, having a partial length of the total length of the spiral antenna branch, forms a second resonant antenna structure for a higher frequency range, and wherein the end portion is coplanar with a portion of the meandering conductive track and is electromagnetically coupled to the meandering conductive track.

* * * * *